US008758068B2

(12) United States Patent
Wang et al.

(10) Patent No.: US 8,758,068 B2
(45) Date of Patent: Jun. 24, 2014

(54) CONTACT SPRING FOR PLUG CONNECTOR SOCKET

(75) Inventors: Yingtao Wang, Guangdong (CN); Junmin Guo, Guangdong (CN)

(73) Assignee: Harting Electronics GmbH (DE)

( * ) Notice: Subject to any disclaimer, the term of this patent is extended or adjusted under 35 U.S.C. 154(b) by 88 days.

(21) Appl. No.: 13/580,183

(22) PCT Filed: May 18, 2010

(86) PCT No.: PCT/CN2010/072874

§ 371 (c)(1),
(2), (4) Date: Aug. 21, 2012

(87) PCT Pub. No.: WO2011/143807

PCT Pub. Date: Nov. 24, 2011

(65) Prior Publication Data

US 2012/0315804 A1 Dec. 13, 2012

(51) Int. Cl.
*H01R 4/48* (2006.01)

(52) U.S. Cl.
USPC ..... 439/816

(58) Field of Classification Search
USPC ..... 439/816, 342, 857, 259, 265–266, 856, 439/733.1
See application file for complete search history.

(56) References Cited

U.S. PATENT DOCUMENTS

| | | | | |
|---|---|---|---|---|
| 3,289,146 | A | 11/1966 | Tuchel | |
| 3,992,076 | A | 11/1976 | Gluntz | 339/258 R |
| 4,045,868 | A | 9/1977 | Ammon et al. | 29/629 |
| 6,183,269 | B1 | 2/2001 | Sarkissian | |
| 6,267,615 | B1 * | 7/2001 | Lin | 439/342 |
| 7,137,841 | B1 | 11/2006 | Liao et al. | 439/342 |
| 7,303,421 | B2 * | 12/2007 | Liao | 439/342 |
| 7,402,066 | B2 * | 7/2008 | Liao | 439/342 |
| 7,621,784 | B2 | 11/2009 | Ichimiya et al. | 439/676 |
| 7,862,364 | B2 * | 1/2011 | Zhang et al. | 439/342 |
| 2008/0305695 | A1 | 12/2008 | Yodogawa | |

FOREIGN PATENT DOCUMENTS

| | | | |
|---|---|---|---|
| EP | 1170827 | 1/2002 | H01R 13/115 |
| JP | 7169523 | 7/1995 | H01R 13/11 |
| KR | 10-2006-0126356 | 12/2006 | |
| NL | 6 404 489 A | 10/1964 | |

OTHER PUBLICATIONS

International Search Report issued for corresponding application No. PCT/CN2010/072874, dated Feb. 24, 2011 (16 pgs).
European Communication, Appln. No. 10851566.9-1801/2572405 PCT/CN2010072874, dated Nov. 18, 2013, 7 pgs.
Korean Office Action w/English translation, Korean Patent Appln. 10-2012-7033127, dated Nov. 15, 2013, 5 pgs.

* cited by examiner

*Primary Examiner* — Jean F Duverne
(74) *Attorney, Agent, or Firm* — Hayes Soloway P.C.

(57) ABSTRACT

A contact spring has two contact arms which are connected at their respective source areas via a bridge and are intended for clamping in and making contact with the mating contact which is to be inserted in an insertion direction. The contact arms are arranged essentially pointing in the opposite direction to the insertion direction of the mating contact running toward one another, and curving away from one another on their free standing end areas. The contact spring has at least one first solder connection which is integrally formed directly on the bridge and faces in the opposite direction to the insertion direction of the mating contact.

21 Claims, 5 Drawing Sheets

CONTACT SPRING FOR PLUG CONNECTOR SOCKET

BACKGROUND OF THE INVENTION

The invention relates to a contact spring for a plug connector socket intended for arrangement and mounting in an insulating body on the one hand and for soldering, in the form of surface mount technology (SMT), to a printed circuit board on the other hand, wherein the contact spring comprises two contact arms which are provided for clamping in and making contact with a mating contact which can be inserted in an insertion direction, and wherein the contact arms are each arranged, starting with a source area and ending with a free standing end area, essentially pointing in the opposite direction to the insertion direction of the mating contact, and first of all running toward one another, and curve away from one another on their free standing end areas, wherein the contact spring furthermore comprises a bridge via which the two contact arms are connected to one another at their respective source areas, and wherein the contact spring comprises at least one first solder connection with at least one contact surface for soldering on the printed circuit board.

In this case, "pointing essentially in the opposite direction to the insertion direction of the mating contact" means that the contact spring is opened in the opposite direction to its insertion direction, in order to hold the mating contact to be inserted, on the free standing end areas of the contact arms.

A contact spring such as this is required in order in particular to fit plug connector sockets using SMT to both sides of printed circuit boards.

DESCRIPTION OF THE PRIOR ART

By way of example, document EP 1 170 827 A2 discloses a contact spring being in the form of a rocker, thus ensuring that the contact spring makes contact with a mating contact with the same contact force at a plurality of points.

The document JP07-169523 A discloses a contact spring for a socket contact. This contact spring has two contact arms, which are connected to one another in their source area via a bridge and point essentially in the direction of a mating contact to be inserted. The contact spring has a solder connection in the form of a pin, for soldering to a printed circuit board using the so-called "press-in" process. This process provides for the solder connection, which is in the form of a pin, to be inserted through an opening through a printed circuit board, and to be soldered.

The document U.S. Pat. No. 7,621,784 B2 discloses a contact spring being designed for SMT applications. The SMT process has the advantage that there is no need for openings through the printed circuit board, and that the printed circuit board can thus be populated on both sides without any problems, thus resulting in an increased fitting density. The document proposes that the insertion direction for the mating contact should be chosen to be at right angles to the direction in which the contact arms open and close. This is intended to avoid mechanical loads on the solder connections. The contact spring has a solder connection on each of the two sides under the contact arms and is intended to be inserted into an insulating body, to be held therein, and to be soldered on a printed circuit board by means of SMT.

However, it has been found that an arrangement which provides for the mating contact to be inserted into the plug connector socket at right angles to the printed circuit board is inadequate for many applications.

OBJECT OF THE INVENTION

The invention is accordingly based on the object of specifying a contact spring which can be produced at low cost, which on the one hand avoids mechanical stresses and forces between its solder connection and printed circuit board even when a mating contact is inserted, and which on the other hand allows the mating contact to be inserted parallel to the printed circuit board.

This object is achieved in that the first solder connection is integrally formed directly on the bridge and points in the opposite direction to the insertion direction of the mating contact.

The invention relates to a contact spring for a plug connector socket which can be soldered to a printed circuit board using SMT. In particular, two such contact springs can be soldered to two opposite contact areas on a printed circuit board which can be populated on both sides, and can make contact at the same time with two mating contacts of a single mating plug.

The advantages achieved by the invention are, in particular, that no constant mechanical stress acts between the solder connection and the printed circuit board even when a mating plug is inserted, since the forces of the two arms compensate for one another at the solder connection which is integrally formed on the bridge.

One particular advantage of the invention is the high electrical conductivity because of the particularly large electrically effective contact areas both between the contact spring and the mating contact and between the contact spring and the printed circuit board.

Mechanically, an axial moment on the solder connection during the insertion process is largely avoided when two contact springs are advantageously soldered onto two opposite contact areas of a printed circuit board which can be populated on both sides, and make contact at the same time with two mating contacts of a single mating plug, because the axial alignment of the mating plug does not change during the insertion process and, in consequence, also does not exert any lever effect on the plug connector socket.

The contact spring additionally and advantageously has a second solder connection which is integrally formed directly on the bridge, opposite and in the opposite direction to the first solder connection. This results in a larger overall contact area being produced between the contact spring and the printed circuit board, thus increasing the conductivity of this connection. This also makes this connection more mechanically robust.

It is also advantageous for the first solder connection to have a guide area which is intended to be inserted into a lower guide recess on an insulating body which is likewise part of the plug connector socket, because this makes it easier to position the contact spring in the insulating body.

It is also advantageous for each contact arm to have a guide element which points in the same direction as the contact arms, because this makes it easier to insert the contact spring into the insulating body. In this case, it is particularly advantageous for the contact spring to have barbs in the area of these contact guide elements, by means of which barbs the contact spring is held in the insulating body with an increased friction force after insertion. It is particularly advantageous in this case for guide slots to be provided in the insulating body, and for the insulating body to be composed of an elastically deformable material at the appropriate points, as a result of which the barbs at least partially bury themselves in this material.

It is also particularly advantageous for the contact arms to have additional spring arms, wherein the spring arms are arranged such that they start on the end areas of the contact arms and are directed in the opposite direction to the contact arms running towards one another in the insertion direction of the mating plug toward in each case one free standing end. In this case, the free standing ends of the spring arms are also intended to make contact with the mating contact, in addition to the free standing end areas of the contact arms. This increases the overall electrically effective contact area between the contact arms and the inserted mating contact, thus also increasing the conductivity associated with this.

Furthermore, in order to reduce the production costs, it is advantageous for the contact spring to be formed integrally. In particular, the contact spring is stamped out and shaped on a resilient material using a stamping and bending technique.

In a corresponding manner, the additional spring arms are stamped out of the material of the contact arms.

In this case, it is advantageous for a free area to remain between the material of the contact arm and the material of the spring arm during the stamping-out process. The shape of the contact arm and the shape of the spring arm can thus be optimized independently of one another, thus resulting only in mechanical stresses which are as small as possible when the inserted mating contact causes elastic deformation.

In particular, it is even possible to produce the effect of a rocker by skilful design of the contact spring, using cost-effective means, when the free standing ends of the spring arms move toward one another by being forced apart from the end areas of the contact arms. When a mating contact has been inserted completely, both the pressure between the end areas of the contact arms and the mating contact and the pressure between the free standing ends of the spring contacts and the mating contact are then increased. This ensures a uniform contact is made in all the contact areas even in the case of mating contacts of different width.

Both contact arms and/or the respectively associated spring arms are advantageously designed to be symmetrical with respect to one another. In particular, it is advantageous for the entire contact spring to be designed with mirror-image symmetry with respect to an associated plane of symmetry, because the optimized shape of one of the two contact spring halves can in this way also be used for the other contact spring half.

The cuboid insulating body advantageously has a connecting opening on a side which is intended to be mounted on the printed circuit board, through which the solder connection of the contact spring makes contact with the printed circuit board. It has a guide groove therein to make it easier to insert the solder connection, as well as a lower guide recess for holding the guide area of the solder connection. It is also advantageous for the insulating body to have guide slots for guidance and fixing of the guide elements of the contact spring, in which case it is particularly advantageous for these guide slots to be incorporated in an elastically deformable material of the insulating body, because the barbs bury themselves particularly deeply in this deformable material, and the contact spring is held correspondingly strongly in the insulating body. Furthermore, the insulating body has a contact opening for insertion of the mating contact. In addition, the insulating body advantageously has guide pins for fixing it in recesses provided for this purpose in the printed circuit board, as well as at least one window for observation and for heat transmission.

BRIEF DESCRIPTION OF THE DRAWINGS

A first exemplary embodiment of the invention is illustrated in FIG. 1*a* to FIG. 1*c* of the drawing, in which.

Figure 2A:
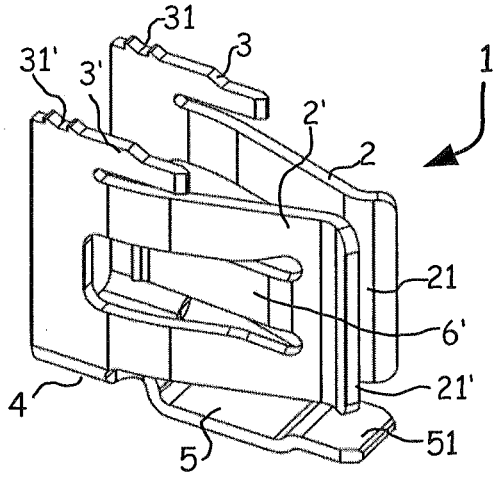
Figure 2B:
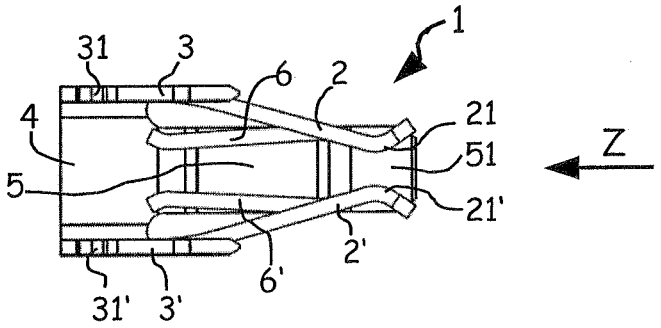
Figure 2C:
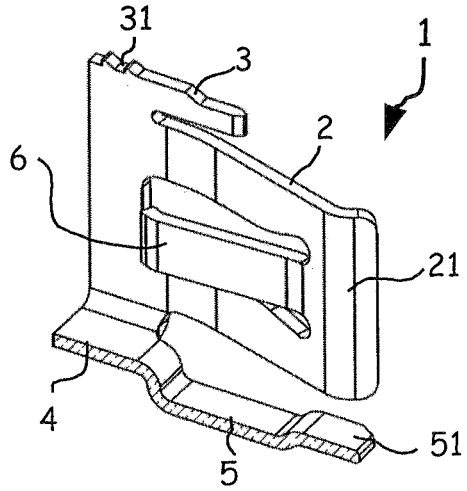

A second exemplary embodiment of the invention is illustrated in FIG. 2*a* to FIG. 2*c* of the drawing, in which:

FIG. 2*a* shows a three-dimensional illustration of a contact spring with additional spring arms, from an oblique viewing direction, FIG. 2*b* shows a three-dimensional illustration of the contact spring from a virtually vertical viewing direction, and FIG. 2*c* shows a three-dimensional illustration of the contact spring, sectioned on its plane of symmetry, from an oblique viewing direction.

Figure 3A:
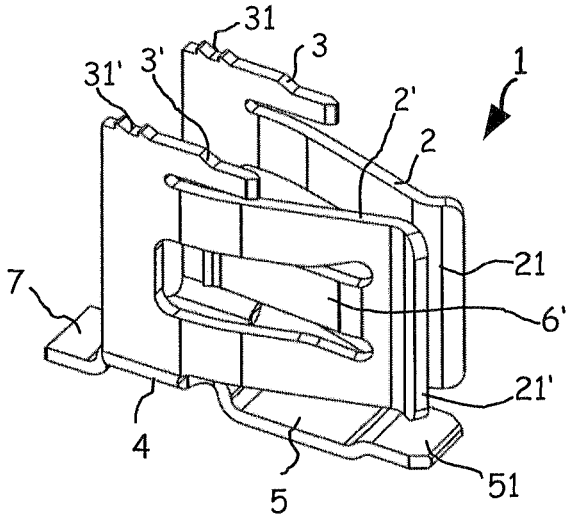
Figure 3B:
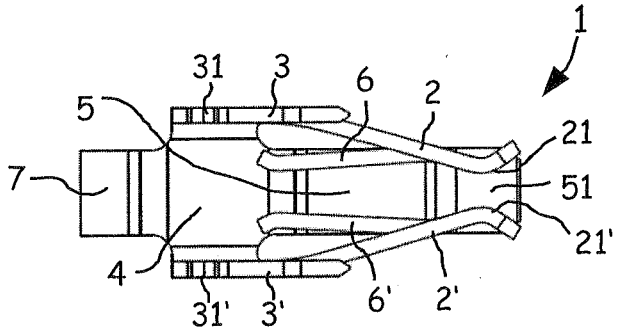
Figure 3C:
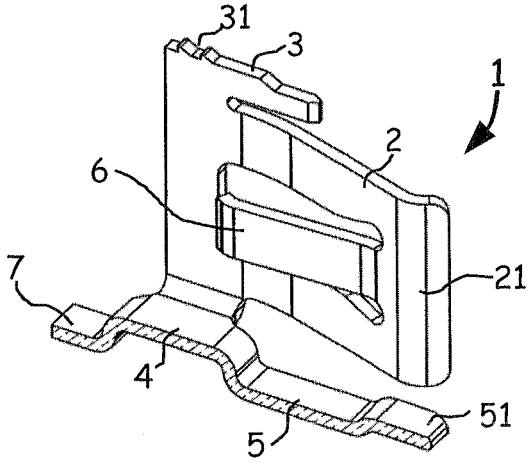

A third exemplary embodiment of the invention is illustrated in FIG. 3*a* to FIG. 3*c* of the drawing, in which:

FIG. 3*a* shows a three-dimensional illustration of a contact spring with additional spring arms and with a second solder connection, from an oblique viewing direction, FIG. 3*b* shows a three-dimensional illustration of the contact spring, from a virtually vertical viewing direction, and FIG. 3*c* shows a three-dimensional illustration of the contact spring, sectioned on its plane of symmetry, from an oblique viewing direction.

Figure 4A:
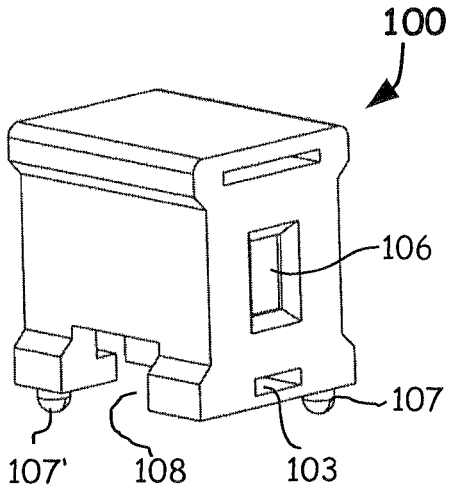
Figure 4B:
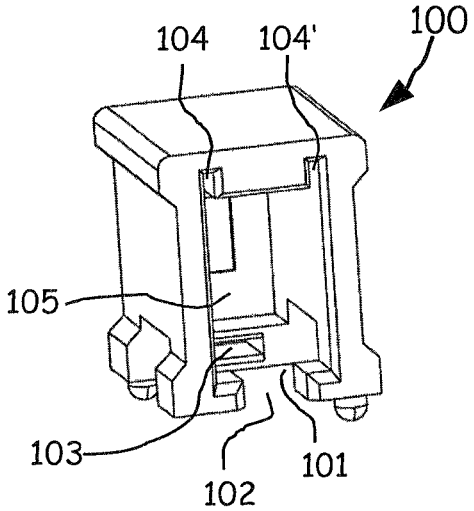
Figure 4C:
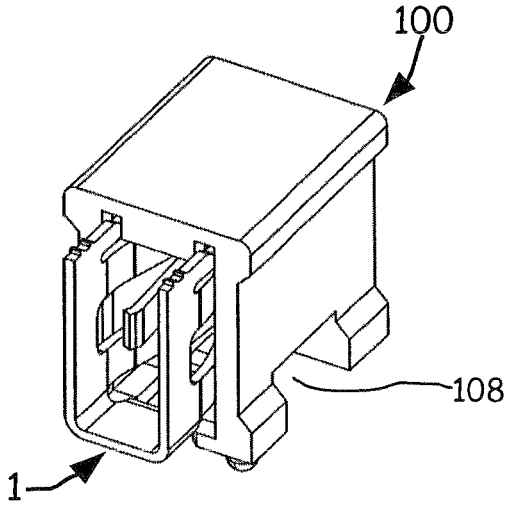
Figure 4D:
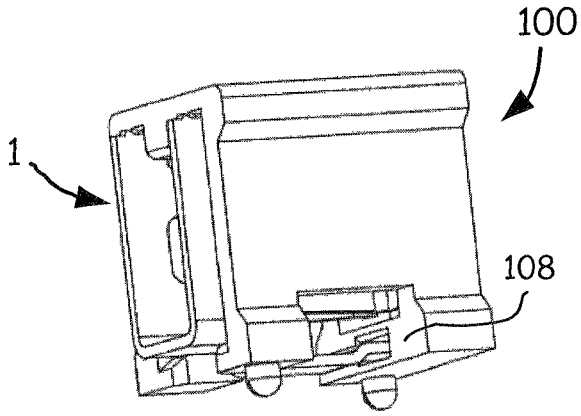
Figure 4E:
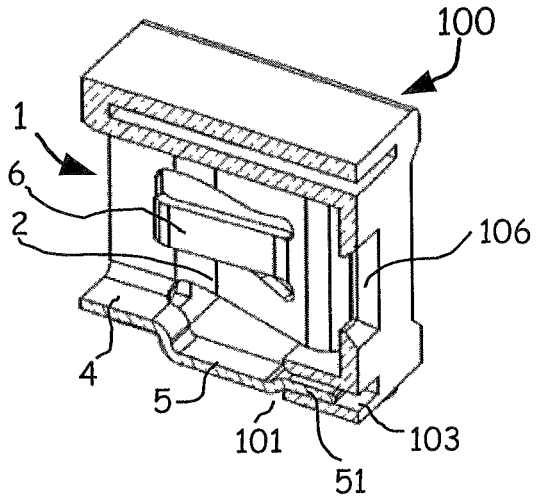

An insulating body, which is intended to hold all the contact springs described in the three exemplary embodiments, is illustrated in FIG. 4*a* to FIG. 4*f* of the drawing, in which:

FIG. 4*a* shows an insulating body with a view of an insertion opening for the contact spring, FIG. 4*b* shows the insulating body with a view of an insertion opening for the mating contact, FIG. 4*c* shows an insulating body with a contact spring during the insertion process, FIG. 4*d* shows an insulating body with an inserted contact spring, with a view of an opening for making contact between the first solder connection and the printed circuit board, FIG. 4*e* shows an insulating body, cut open along its plane of symmetry, with an inserted contact spring, in the form of a cross section through an associated plane of symmetry.

Figure 5:
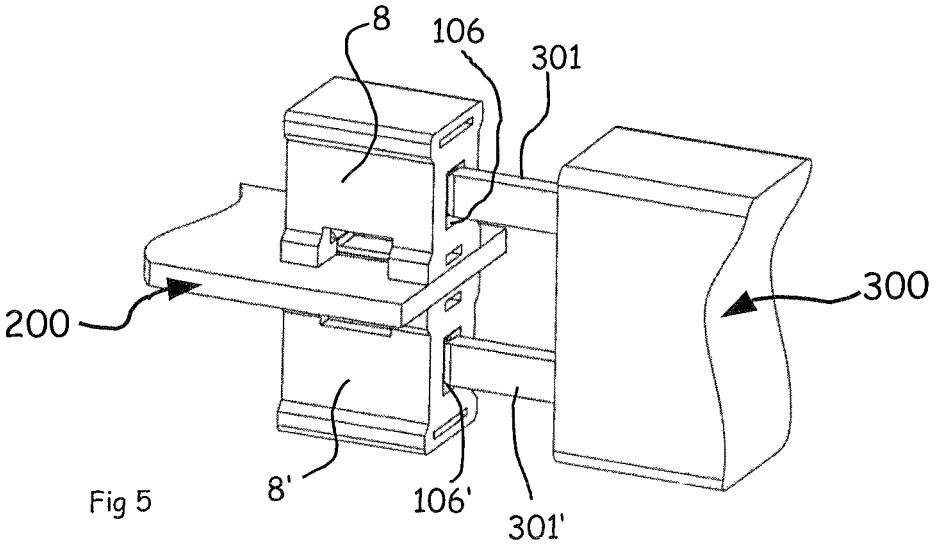

A fourth preferred exemplary embodiment is illustrated in FIG. 5, in which:

FIG. 5 shows an arrangement comprising two plug connector sockets, one printed circuit board and one mating plug.

DETAILED DESCRIPTION OF THE INVENTION

Figure 1A:
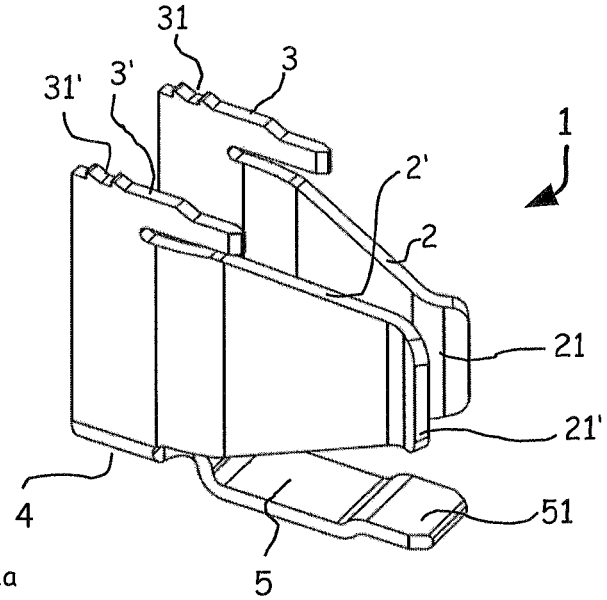
FIG. 1*a* shows a three-dimensional illustration of a contact spring, from an oblique viewing direction.
Figure 1B:
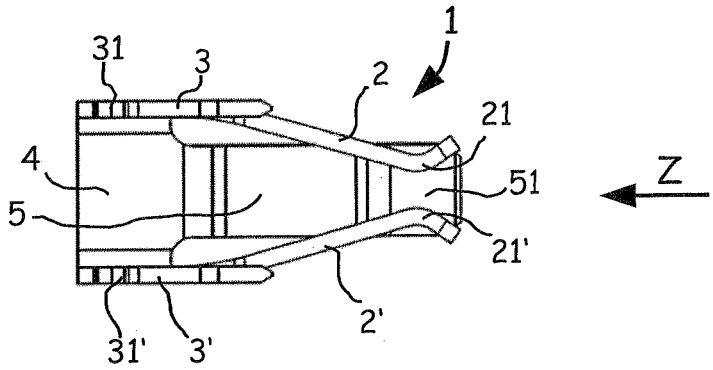
FIG. 1*b* shows a three-dimensional illustration of the contact spring, from a virtually vertical viewing direction.
Figure 1C:
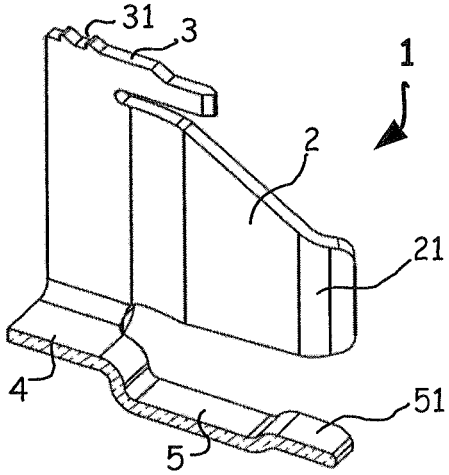
FIG. 1*c* shows a three-dimensional illustration of the contact spring, sectioned on its plane of symmetry, from an oblique viewing direction.

FIG. 1*a* shows a contact spring 1, in an oblique viewing direction. FIG. 1*b* illustrates the contact spring 1 in a virtually vertical viewing direction. FIG. 1*c* illustrates the contact spring 1, sectioned on its plane of symmetry, in an oblique viewing direction.

The contact spring 1 is produced from an electrically conductive and resilient material, using a stamping and bending technique.

The contact spring 1 has mutually symmetrical contact arms 2, 2', each having an associated guide element 3, 3'. Furthermore, the contact spring has a bridge 4 which connects the two contact arms 2, 2' to one another in their source areas. The free standing end areas 21, 21' of the two slightly curved contact arms 2, 2' point essentially in the opposite direction to the insertion direction Z of a mating contact 301 to be inserted, and are first of all aligned such that they run slightly toward one another. The two contact arms 2, 2' are shaped such that they bend away from one another at the end areas 21, 21', and, in order to hold the mating contact 301 to be inserted, are therefore opened in the opposite direction to the insertion direction Z of the latter.

In the area of the guide elements 3, 3', the contact spring 1 has barbs 31, 31' which are used to hold the contact spring in an insulating body 100 with an increased friction force.

A first solder connection 5 for soldering on a printed circuit board 200 is integrally formed on the bridge 4. This first solder connection 5 points essentially in the same direction as the two contact arms 2, 2'. The first solder connection 5 has a guide area 51 at its free standing end.

SECOND EXEMPLARY EMBODIMENT

FIG. 2*a* shows a contact spring 1, in an oblique viewing direction. FIG. 2*b* illustrates this contact spring in a virtually vertical viewing direction. FIG. 2*c* illustrates the contact spring 1, sectioned on its plane of symmetry, in an oblique viewing direction.

The contact spring 1 is produced from an electrically conductive and resilient material, using a stamping and bending technique.

The contact spring 1 has two mutually symmetrical contact arms 2, 2', each having an associated guide element 3, 3'. Furthermore, the contact spring has a bridge 4 which connects the two contact arms 2, 2' to one another in their source areas. The free standing end areas 21, 21' of the two slightly curved contact arms 2, 2' point essentially in the opposite direction to the insertion direction Z of a mating contact 301 to be inserted, and are first of all aligned such that they run slightly toward one another. The two contact arms 2, 2' are shaped such that they bend away from one another at their end areas 21, 21', and, in order to hold the mating contact 301 to be inserted, are therefore opened in the opposite direction to the insertion direction Z of the latter.

Two additional spring arms 6, 6' are stamped out of the contact arms on three sides, such that they are free standing. On the end areas 21, 21' of the contact arms 2, 2', these spring arms 6, 6' are connected thereto. Starting there and in the opposite direction to the contact arms 2, 2', the additional spring arms 6, 6' are arranged with in each case one free standing end running toward one another in the insertion direction Z of the mating plug.

In the area of the guide elements 3, 3', the contact spring 1 has barbs 31, 31' which are used to hold the contact spring in an insulating body 100 with an increased friction force.

A first solder connection 5 is integrally formed on the bridge 4, for soldering to a printed circuit board 200. This first solder connection 5 points essentially in the same direction as the two contact arms 2, 2'. The first solder connection 5 has a guide area 51 at its free standing end.

THIRD EXEMPLARY EMBODIMENT

FIG. 3*a* shows a contact spring 1, in an oblique viewing direction. FIG. 3*b* illustrates this contact spring in a virtually vertical viewing direction. FIG. 3*c* illustrates the contact spring 1, sectioned on its plane of symmetry, in an oblique viewing direction.

The contact spring 1 is produced from an electrically conductive and resilient material, using a stamping and bending technique.

The contact spring has two mutually symmetrical contact arms 2, 2', each having an associated guide element 3, 3'. Furthermore, the contact spring has a bridge 4 which connects the two contact arms to one another in their source areas. The free standing end areas 21, 21' of the two slightly curved contact arms 2, 2' point essentially in the opposite direction to the insertion direction Z of a mating contact to be inserted, and are first of all aligned such that they run slightly toward one another. The two contact arms 2, 2' are shaped such that they bend away from one another at their end areas 21, 21', and, in order to hold the mating contact 301 to be inserted, are therefore opened in the opposite direction to the insertion direction Z of the latter.

Two additional spring arms 6, 6' are stamped out of the contact arms on three sides, such that they are free standing. On the end areas 21, 21' of the contact arms 2, 2', these spring arms 6, 6' are connected thereto. Starting there and in the opposite direction to the contact arms 2, 2', the additional spring arms 6, 6' are arranged with in each case one free standing end running toward one another in the insertion direction Z of the mating plug.

In the area of the guide elements 3, 3', the contact spring 1 has barbs 31, 31' which are used to hold the contact spring in an insulating body 100 with an increased friction force.

A first solder connection 5 is integrally formed on the bridge 4, for soldering to a printed circuit board 200. This first solder connection 5 points essentially in the same direction as the two contact arms 2, 2'. The first solder connection 5 has a guide area 51 at its free standing end.

In addition, the contact spring has a second solder connection 7, which is integrally formed directly on the bridge 4 opposite, and directed in the opposite direction to the first solder connection 5. This results in a larger overall contact area being produced between the contact spring 1 and the printed circuit board 200, thus increasing the conductivity of this connection.

An associated insulating body 100, which belongs, together with the contact spring 1, to a plug connector socket 8, is a common feature of the first, the second and the third exemplary embodiments.

As can be seen from FIG. 4*a*, the insulating body 100 is cuboid and has a contact opening 106 for insertion of the mating contact 301. Furthermore, the insulating body has two guide pins 107, 107' for fixing in recesses provided for this purpose in the printed circuit board 200, as well as a further window 108 for observation and for heat transmission while soldering using SMT.

As can be seen from the illustration in FIG. 4*b*, the insulating body 100 has a connecting opening 101 on a side which is intended for mounting on the printed circuit board 200, said connecting opening 101 allows contact to be made between the first solder connection 5 on the printed circuit board 200. Therein, it has a guide groove 102 for easy insertion and for guidance of the first solder connection 5, as well as a lower guide recess 103 for holding the guide area 51 of the solder connection 5. It is also advantageous for the insulating body 100 to have guide slots 104, 104' for guiding and fixing the guide elements 3, 3' of the contact spring. In this case, these guide slots 104, 104' can be incorporated in an elastically deformable material of the insulating body 100.

FIG. 4*c* and FIG. 4*d* show how a contact spring 1 is inserted through this mounting opening 105 into the insulating body 100. For this purpose, the solder connection 5 is first of all inserted into the guide groove 102. As the contact spring 1 is inserted further, the guide area 51 of the solder connection 5 is inserted into the guide recess 103 in the insulating body 100. At the same time, the guide elements 3, 3' are pushed into the associated guide slots 104, 104' in the insulating body 100, with the barbs 31, 31' on the contact spring 1 burying themselves in the material of the insulating body 100, which can be deformed elastically in this area.

FIG. 4*e* shows a fitted plug connector socket, sectioned on its plane of symmetry, with a view of the contact opening 106. In this case, the connecting opening 101 can be seen particularly well, with the solder connection 5 inserted into it as well as the guide recess 103 with the guide area 51 of the solder connection 5 inserted into it.

FOURTH EXEMPLARY EMBODIMENT

FIG. 5 shows an arrangement with a printed circuit board 200 and two plug connector sockets 8. These plug connector sockets 8 are arranged opposite on two sides of the edge of a printed circuit board 200, and are soldered by means of the solder connections 5, 7 on their respective contact spring 1 to opposite connections on the printed circuit board 200, using SMT. The contact openings 106, 106' in the insulating body 100 are in this case located at the edge of the printed circuit board 200.

A single mating plug 300 with two mating contacts 301 is inserted at the same time into these contact openings 106, 106' over the edge of the printed circuit board 200. This automatically avoids axial deflection of the mating plug 300, and no corresponding mechanical lever moment acts on the solder connections 5, 7 of the two plug connector sockets 8, 8'.

LIST OF REFERENCE SYMBOLS

1 Contact spring
2, 2' Contact arms
21, 21' End areas of the contact arms
3, 3' Guide elements
31, 31' Barbs
4 Bridge
5 First solder connection
51 Guide area
6, 6' Additional spring arms
7 Second solder connection
8, 8' Plug connector socket
100 Insulating body
101 Connecting opening
102 Guide groove
103 Guide recess
104, 104' Guide slots
105 Mounting opening
106 Contact opening
107 Guide pin
108 Window
200 Printed circuit board
300 Mating plug
301, 301' Mating contacts

The invention claimed is:

1. A contact spring for a plug connector socket intended for arrangement and mounting in an insulating body on the one hand and for soldering, in the form of surface mount technology (SMT), to a printed circuit board on the other hand, wherein the contact spring comprises two contact arms which are provided for clamping in and making contact with a mating contact which is to be inserted in an insertion direction, and wherein the contact arms are each arranged, starting with a source area and ending with a free standing end area, essentially pointing in the opposite direction to the insertion direction of the mating contact, and first of all running toward one another, and curve away from one another on their free standing end areas, wherein the contact spring furthermore comprises a bridge via which the two contact arms are connected to one another at their respective source areas, and wherein the contact spring comprises at least one first solder connection with at least one contact surface for soldering on the printed circuit board, wherein the first solder connection is integrally formed directly on the bridge and points in the opposite direction to the insertion direction of the mating contact, and wherein the contact spring additionally has a second solder connection, which is integrally formed directly on the bridge, and in an opposite direction to the first solder connection.

2. The contact spring as claimed in claim 1, wherein additional spring arms are integrally formed on the end areas of the contact arms, wherein the spring arms are arranged such that they start on these end areas of the contact arms and are directed in the opposite direction to the contact arms running towards one another $in_1$ the insertion direction of the mating plug with in each case a free standing end.

3. The contact spring as claimed in claim 1, wherein additional spring arms are stamped out of the contact arms, wherein the spring arms are arranged such that they start on the end areas of the contact arms and are directed in the opposite direction to the contact arms running towards one another in the insertion direction of the mating plug toward in each case a free standing end.

4. The contact spring as claimed in claim 1, wherein the contact spring is stamped and shaped from a resilient material.

5. The contact spring as claimed in claim 4, wherein a free area remains between the material of the contact arm and the material of the spring arm when the contact spring is stamped out.

6. The contact spring as claimed in claim 1, wherein the contact spring is formed integrally.

7. The contact spring as claimed in claim 1, wherein the two contact arms are formed symmetrically with respect to one another.

8. The contact spring as claimed in claim 1, wherein the contact spring is designed with mirror-image symmetry with respect to an associated plane of symmetry.

9. A contact spring for a plug connector socket intended for arrangement and mounting in an insulating body on the one hand and for soldering, in the form of surface mount technology (SMT), to a printed circuit board on the other hand, wherein the contact spring comprises two contact arms which are provided for clamping in and making contact with a mating contact which is to be inserted in an insertion direction, and wherein the contact arms are each arranged, starting with a source area and ending with a free standing end area, essentially pointing in the opposite direction to the insertion direction of the mating contact, and first of all running toward one another, and curve away from one another on their free standing end areas, wherein the contact spring furthermore comprises a bridge via which the two contact arms are connected to one another at their respective source areas, wherein the contact spring comprises at least one first solder connection with at least one contact surface for soldering on the printed circuit board, wherein the first solder connection is integrally formed directly on the bridge and points in the opposite direction to the insertion direction of the mating contact, and wherein additional spring arms are integrally formed on the end areas of the contact arms, wherein the spring arms are arranged such that they start on these end areas of the contact arms and are directed in an opposite direction to the contact arms running towards one another in the insertion direction of the mating plug with in each case a free standing end.

10. The contact spring as claimed in claim 9, wherein additional spring arms are stamped out of the contact arms, wherein the spring arms are arranged such that they start on the end areas of the contact arms and are directed in the opposite direction to the contact arms running towards one another in the insertion direction of the mating plug toward in each case a free standing end.

11. The contact spring as claimed in claim 9, wherein the contact spring is stamped and shaped from a resilient material.

12. The contact spring as claimed in claim 11, wherein a free area remains between the material of the contact arm and the material of the spring arm when the contact spring is stamped out.

13. The contact spring as claimed in claim 9, wherein the contact spring is formed integrally.

14. The contact spring as claimed in claim 9, wherein the two contact arms are formed symmetrically with respect to one another.

15. The contact spring as claimed in claim 9, wherein the contact spring is designed with mirror-image symmetry with respect to an associated plane of symmetry.

16. A contact spring for a plug connector socket intended for arrangement and mounting in an insulating body on the one hand and for soldering, in the form of surface mount technology (SMT), to a printed circuit board on the other hand, wherein the contact spring comprises two contact arms which are provided for clamping in and making contact with a mating contact which is to be inserted in an insertion direction, and wherein the contact arms are each arranged, starting with a source area and ending with a free standing end area, essentially pointing in the opposite direction to the insertion direction of the mating contact, and first of all running toward one another, and curve away from one another on their free standing end areas, wherein the contact spring furthermore comprises a bridge via which the two contact arms are connected to one another at their respective source areas, and wherein the contact spring comprises at least one first solder connection with at least one contact surface for soldering on the printed circuit board, wherein the first solder connection is integrally formed directly on the bridge and points in an opposite direction to the insertion direction of the mating mating contact, and wherein additional spring arms are stamped out of the contact arms, wherein the spring arms are arranged such that they start on the end areas of the contact arms and are directed in the opposite direction to the contact arms running towards one another in the insertion direction of the mating plug toward in each case a free standing end.

17. The contact spring as claimed in claim 16, wherein the contact spring is stamped and shaped from a resilient material.

18. The contact spring as claimed in claim 17, wherein a free area remains between the material of the contact arm and the material of the spring arm when the contact spring is stamped out.

19. The contact spring as claimed in claim 16, wherein the contact spring is formed integrally.

20. The contact spring as claimed in claim 16, wherein the two contact arms are formed symmetrically with respect to one another.

21. The contact spring as claimed in claim 16, wherein the contact spring is designed with mirror-image symmetry with respect to an associated plane of symmetry.

* * * * *